US009364097B2

(12) United States Patent
Hsiao

(10) Patent No.: US 9,364,097 B2
(45) Date of Patent: Jun. 14, 2016

(54) FIXING MOUNT FOR FIXING AN ELASTIC STRIP ON A CHAIR

(71) Applicant: Ting-Han Hsiao, Tainan (TW)

(72) Inventor: Ting-Han Hsiao, Tainan (TW)

( * ) Notice: Subject to any disclaimer, the term of this patent is extended or adjusted under 35 U.S.C. 154(b) by 82 days.

(21) Appl. No.: 14/467,091

(22) Filed: Aug. 25, 2014

(65) Prior Publication Data

US 2016/0051062 A1 Feb. 25, 2016

(51) Int. Cl.
*A47C 31/02* (2006.01)
*A47C 5/06* (2006.01)

(52) U.S. Cl.
CPC ..... *A47C 31/023* (2013.01); *A47C 5/06* (2013.01); *A47C 31/02* (2013.01); *Y10T 24/4727* (2015.01)

(58) Field of Classification Search
CPC ..... A47C 7/32; A47C 31/04; A47C 7/282; A47C 4/28; A47C 31/00; A47C 31/023; A47C 31/02; Y10T 24/4727; Y10T 24/1498
See application file for complete search history.

(56) References Cited

U.S. PATENT DOCUMENTS

| | | | | |
|---|---|---|---|---|
| 6,056,367 A * | 5/2000 | Hsiao | A47C 7/024 297/452.63 |
| 6,074,013 A * | 6/2000 | Hsiao | A47C 5/06 297/440.1 |
| 7,568,769 B1 * | 8/2009 | Chuang | A47C 7/024 297/452.58 |
| 2008/0191528 A1 * | 8/2008 | Hsiao | A47C 31/00 297/218.4 |

* cited by examiner

*Primary Examiner* — Robert J Sandy
*Assistant Examiner* — Michael Lee
(74) *Attorney, Agent, or Firm* — Alan D. Kamrath; Kamrath IP Lawfirm, P.A.

(57) ABSTRACT

A fixing mount for fixing an elastic strip includes a body and multiple assembling seats. The body has a front face, a back face located opposite to the front face, an inner surface connected with the front face and the back face, an outer surface located opposite to the inner surface, a mounting space surrounded by the front face, the back face and the inner surface, and at least one through hole formed through the inner surface and communicating with the mounting space. The assembling seats are formed on the outer surface and are located in the mounting space. The fixing mount can be mounted on a chair frame without exposing screws, and dirt will not fall in and accumulate in the through holes easily.

2 Claims, 8 Drawing Sheets

FIXING MOUNT FOR FIXING AN ELASTIC STRIP ON A CHAIR

BACKGROUND OF THE INVENTION

1. Field of the Invention

The present invention relates to a fixing component for a chair and more particularly to a fixing mount for fixing an elastic strip on a chair.

2. Description of Related Art

With reference to FIGS. 7 and 8, an elastic chair includes a chair frame 90 and multiple support units. The chair frame 90 has multiple screw holes 96 formed in the chair frame 90. The support units include two connecting seats 91, two elastic strips 92 and multiple screws 97. Each connecting seat 91 has multiple mounting recesses 94 formed in a top 93 of the connecting seat 91 and multiple through holes 95 formed in a bottom surface of each mounting recess 94. The elastic strips 92 are connected with the connecting seats 91. The screws 97 are screwed into the screw holes 96 via the mounting recesses 94 and the through holes 95, respectively. Thus, when the support units are mounted firmly on the chair frame 90, the support units become a chair seat and chair back for seating.

However, when the screws 97 are mounted in the mounting recesses 94 and the through holes 95, the screws 97 are exposed from the chair frame 90, and clothing of a user may be accidentally hooked by the screws 97 and torn. In addition, the appearance of the elastic chair is not attractive, and dirt will accumulate in the mounting recesses 94 and the through holes 95.

To overcome the shortcomings of the conventional elastic chair, the present invention provides a fixing mount for fixing an elastic strip to mitigate or obviate the aforementioned problems.

SUMMARY OF THE INVENTION

The main objective of the present invention is to provide a fixing mount for fixing an elastic strip. The fixing mount includes a body and multiple assembling seats. The body has a front face, a back face located opposite to the front face, an inner surface connected with the front face and the back face, an outer surface located opposite to the inner surface, a mounting space surrounded by the front face, the back face and the inner surface, and at least one through hole formed through the inner surface and communicating with the mounting space. The assembling seats are formed on the outer surface and are located in the mounting space.

Other objectives, advantages, and novel features of the invention will become more apparent from the following detailed description when taken in conjunction with the accompanying drawing.

DETAILED DESCRIPTION OF PREFERRED EMBODIMENTS

Figure 1:
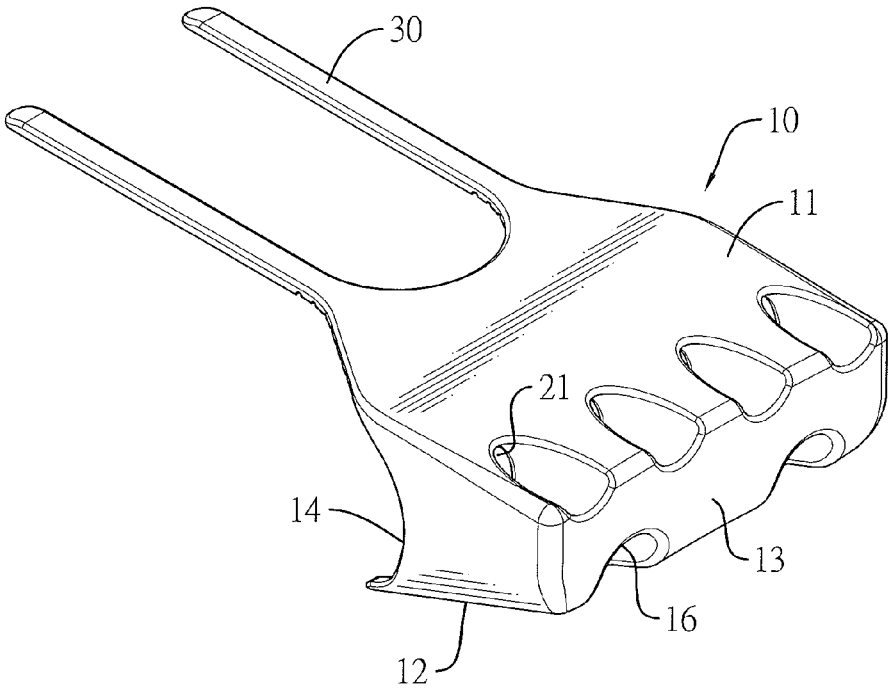
FIG. 1 is a perspective view of a fixing mount for fixing an elastic strip in accordance with the present invention.
Figure 2:
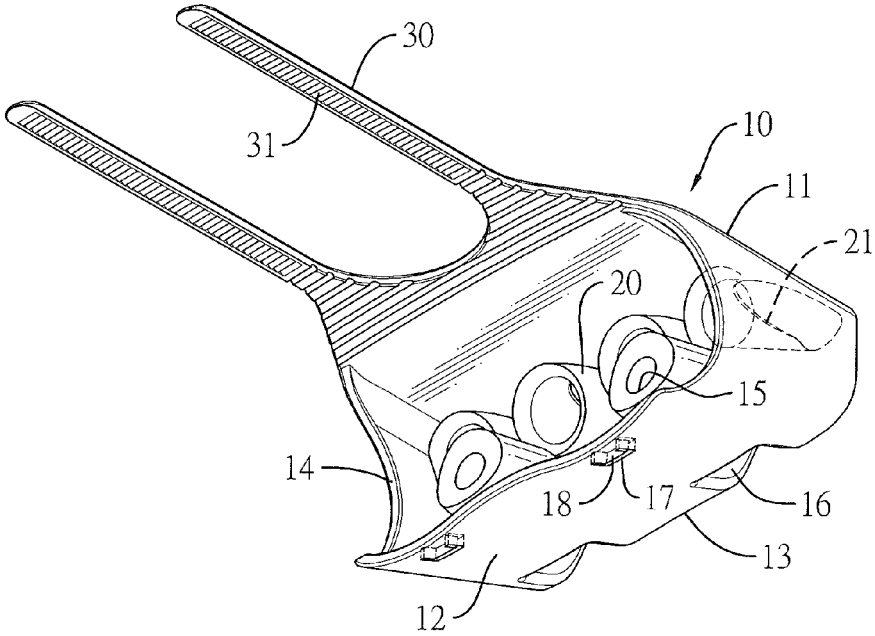
FIG. 2 is another perspective view of the fixing mount in FIG. 1.
Figure 3:
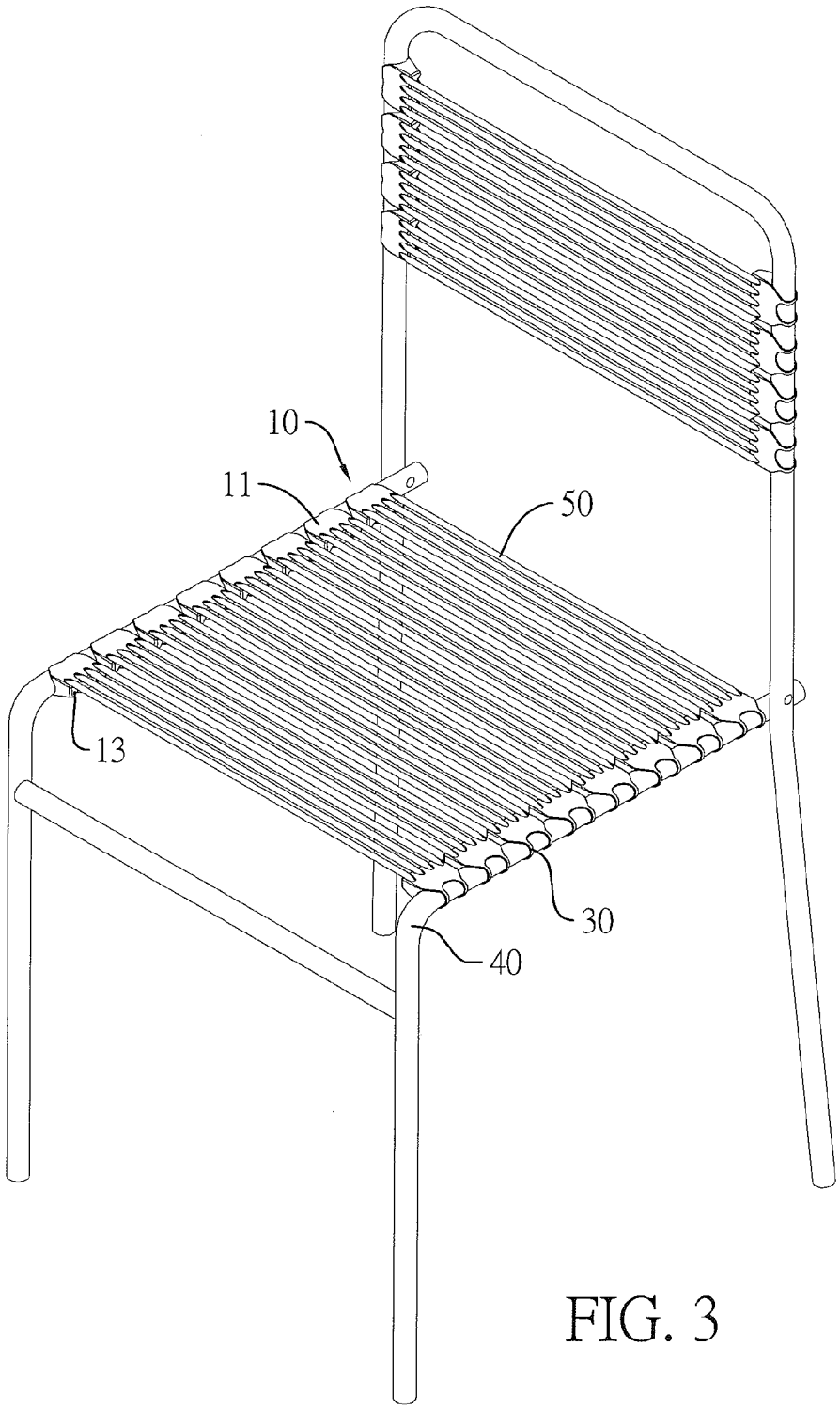
FIG. 3 is a perspective view of a chair with multiple fixing mounts in FIG. 1.
Figure 4:
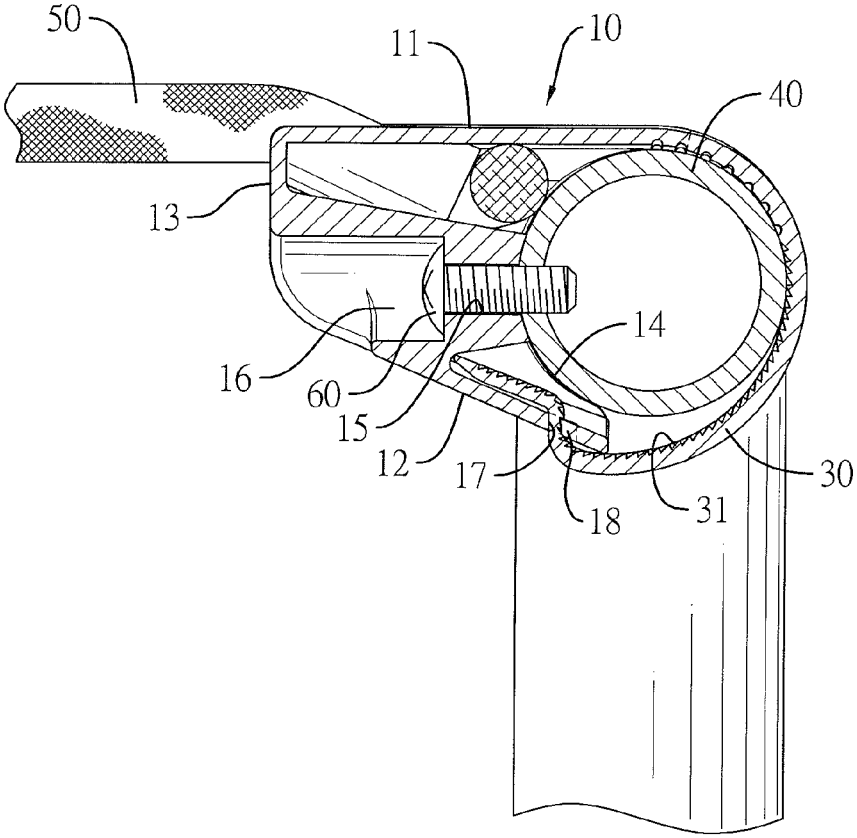
FIG. 4 is an enlarged side view in partial section of the fixing mount in FIG. 3.
Figure 5:
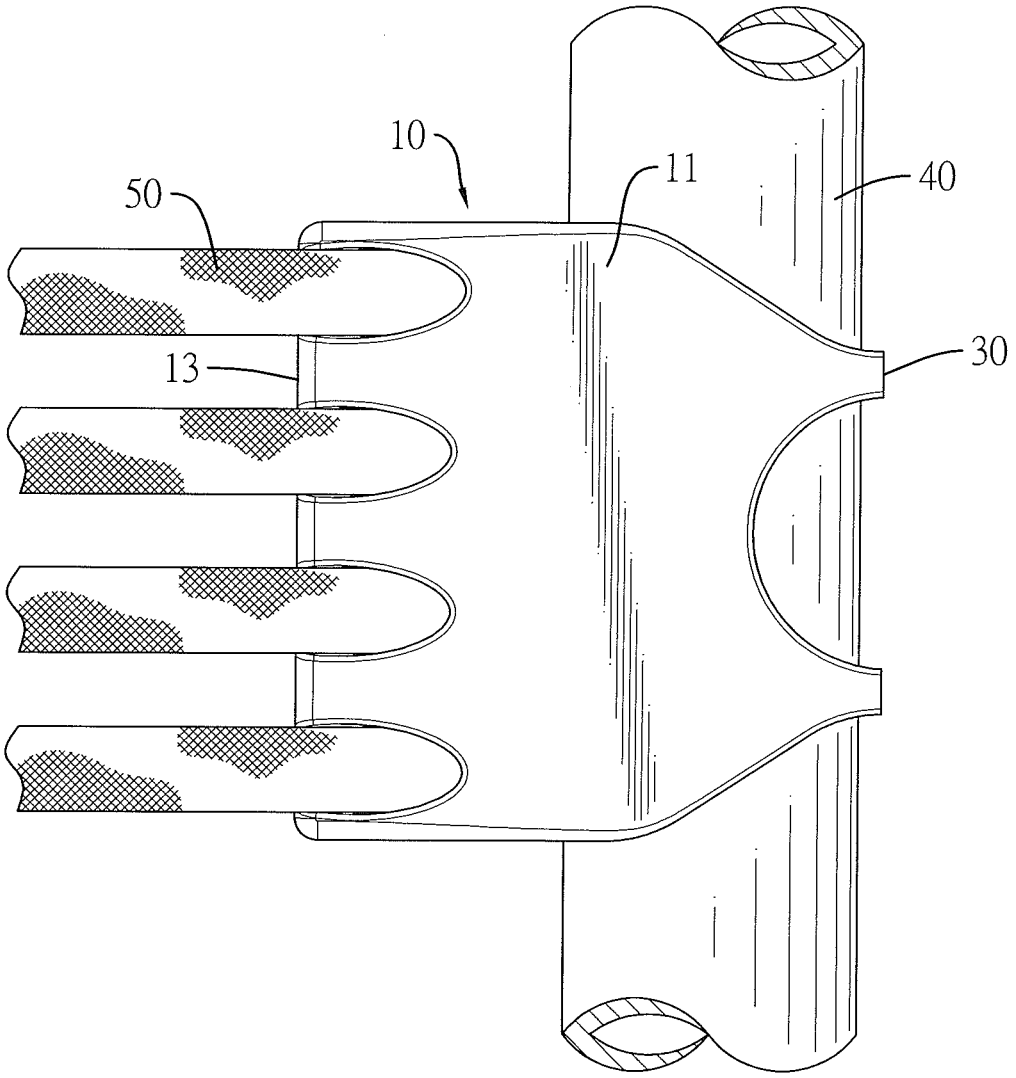
FIG. 5 is an enlarged top view of the fixing mount in FIG. 3.
Figure 6:
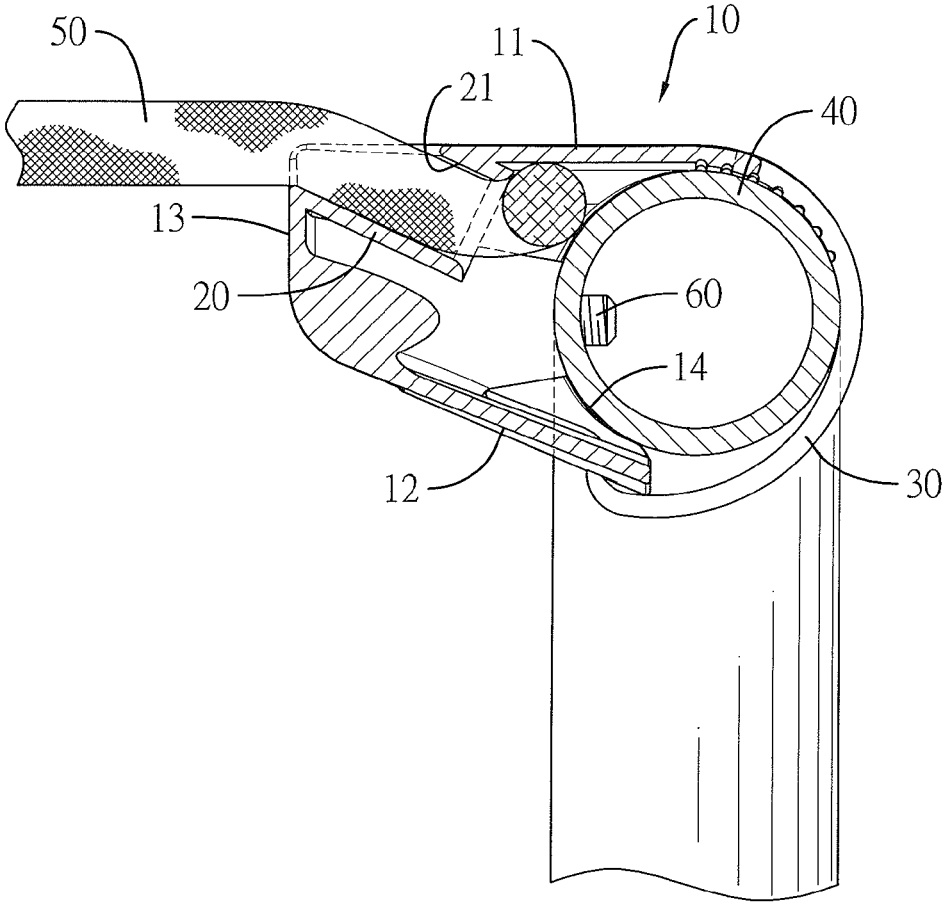
FIG. 6 is another enlarged side view in partial section of the fixing mount in FIG. 3.
Figure 7:
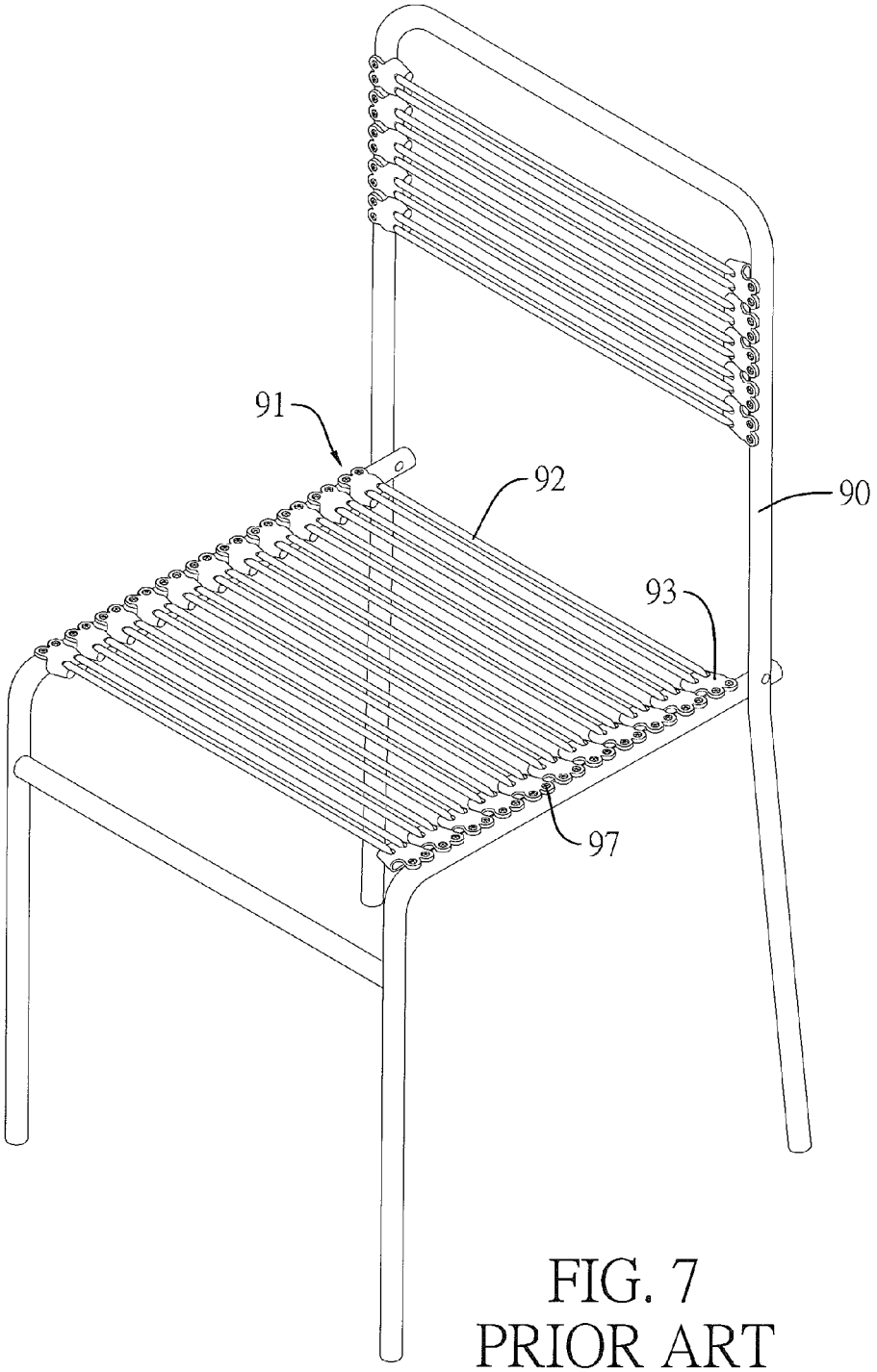
FIG. 7 PRIOR ART
FIG. 7 is a perspective view of a conventional elastic chair.
Figure 8:
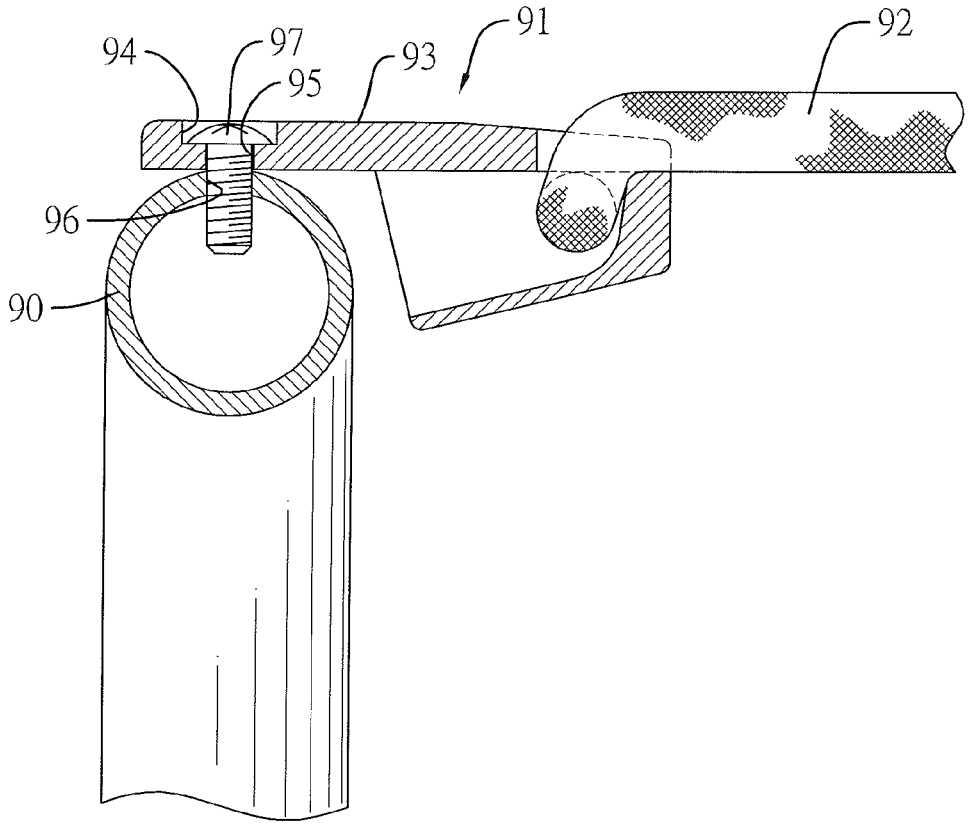
FIG. 8 PRIOR ART
FIG. 8 is an enlarged side view in partial section of the conventional elastic chair in FIG. 7.

With reference to FIGS. 1 and 2, a preferred embodiment of a fixing mount for fixing an elastic strip includes a body 10 and multiple assembling seats 20.

The body 10 has a front face 11, a back face 12, an inner surface 13, an outer surface, two side walls, two positioning portions 14, a mounting space, at least one through hole 15, and at least one recess 16. The back face 12 is located opposite to the front face 11. The inner surface 13 is connected with the front face 11 and the back face 12 and located opposite to the outer surface. Each side wall is connected with one side of the front face 11 and one side of the back face 12. The positioning portions 14 are concave and are respectively formed in the side walls of the body 10. The mounting space is formed in the body 10 and is surrounded by the front face, the back face and the inner surface. The at least one through hole 15 is formed through the inner surface 13 and communicates with the mounting space, and preferably, two through holes 15 are implemented. Each recess 16 is formed in the inner surface 13 and corresponds in position to one of the through holes 15.

The assembling seats 20 are formed on the outer surface and are located in the mounting space. Each assembling seat 20 has a strip outlet 21 formed in the front face 11 of the body 10 and communicating with the mounting space.

Preferably, the body 10 further has a support component extending from a periphery of the front face 11 and including at least one cable tie 30, and preferably, two cable ties 30 are implemented. Each cable tie 30 has multiple ratchets 31 formed on an inner side of the cable tie 30 and facing the back face 12 of the body 10. Two positioning holes 17 are formed in the back face 12. Each positioning hole 17 has a positioning portion 18 formed around the positioning hole 17 and corresponding in shape to the ratchets 31 of the cable tie 30.

With reference to FIGS. 3 to 6, the positioning portion 14 of the body 10 is mounted on a chair frame 40 by two screws 60. The screws 60 are respectively mounted in the at least one recess 16, are inserted through the through holes 15 and are connected with the chair frame 40. The cable tie 30 is bent around the chair frame 40, and the free end of the cable tie 30 is inserted into the positioning hole 17 and the mounting space. The ratchets 31 of the cable tie 30 are engaged with the positioning portion 18 to fix the body 10 on the chair frame 40 and to adjust the relative position of the body 10 on the chair frame 40. Multiple elastic strips 50 are respectively mounted through the strip outlets 21 and are fixed in the assembling seats 20. Two fixing mounts and at least one elastic strip 50 are combined as a support unit, and multiple support units can be arranged as a chair seat or a chair back for seating.

The front face 11 of the body 10 is located at a top side of the chair seat or a front side of the chair back, and the fixing mount in accordance with the present invention can be mounted on the chair frame without exposing the screws 60, so that the appearance of the chair is aesthetic and attractive and so that the clothing of a user will not be accidentally hooked by the screws 60 and torn. Furthermore, the through holes 15 and the screws 60 are hidden in the inner surface 13, so the dirt will not fall in and accumulate in the through holes 15 or the recesses 16 easily.

Even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A fixing mount comprising:

a body having:

a front face;

a back face located opposite to the front face;

an inner surface connected with the front face and the back face;

an outer surface located opposite to the inner surface;

two positioning portions formed in two sides of the outer surface;

a mounting space formed in the body and surrounded by the front face, the back face and the inner surface;

at least one through hole formed through the inner surface and communicating with the mounting space; and a support component extending from a periphery of the front face and including at least one cable tie, wherein each one of the at least one cable tie has multiple ratchets formed on an inner side of the cable tie and facing the back face of the body, wherein the back face of the body further has at least one positioning hole formed in the back face, and wherein each one of the at least one positioning hole has a positioning portion formed around the at least one positioning hole and corresponding in shape to the multiple ratchets of the at least one cable tie; and multiple assembling seats formed on the outer surface and located in the mounting space, with each assembling seat having a strip outlet formed in the front face of the body and communicating with the mounting space.

2. The fixing mount as claimed in claim 1, wherein the body has at least one recess formed in the inner surface and corresponding in position to the at least one through hole.

* * * * *